US006527118B2

(12) United States Patent
Rolland

(10) Patent No.: US 6,527,118 B2
(45) Date of Patent: Mar. 4, 2003

(54) CASE FOR DIFFERENT CARDS

(75) Inventor: Dominique Rolland, Montpellier (FR)

(73) Assignee: Solution Informatique Modulaire Sarl., Pit de la Pompignane (FR)

( * ) Notice: Subject to any disclaimer, the term of this patent is extended or adjusted under 35 U.S.C. 154(b) by 0 days.

(21) Appl. No.: 09/976,273

(22) Filed: Oct. 15, 2001

(65) Prior Publication Data

US 2002/0053530 A1 May 9, 2002

Related U.S. Application Data

(63) Continuation of application No. PCT/FR00/00906, filed on Apr. 10, 2000.

(51) Int. Cl.[7] ..... B65D 85/48

(52) U.S. Cl. ..... 206/449; 206/39; 206/38; 150/147

(58) Field of Search ..... 206/39, 39.4, 39.5, 206/38, 425, 449, 455, 456; 150/147; 229/126, 141, 152; 40/624, 649

(56) References Cited

U.S. PATENT DOCUMENTS

| | | | | | |
|---|---|---|---|---|---|
| 155,676 | A | * | 10/1874 | Robeson | 229/146 |
| 1,917,120 | A | * | 7/1933 | Howell, Jr. | 206/249 |
| 2,258,316 | A | * | 10/1941 | Buxton | 150/147 |
| 2,265,279 | A | * | 12/1941 | Graf | 229/117.07 |
| 2,557,523 | A | * | 6/1951 | Victor | 150/147 |
| 2,658,544 | A | * | 11/1953 | Osaka | 150/138 |
| 3,421,658 | A | * | 1/1969 | Cooksey | 206/358 |
| 5,069,333 | A | * | 12/1991 | Chen | 150/147 |
| 5,257,656 | A | * | 11/1993 | McLeroy | 150/132 |
| 6,082,581 | A | * | 7/2000 | Anderson et al. | 221/232 |
| 6,155,410 | A | * | 12/2000 | Davis | 150/147 |

FOREIGN PATENT DOCUMENTS

| | | | | |
|---|---|---|---|---|
| DE | 35 37 499 | | 4/1987 | |
| EP | 515327 | A1 * | 11/1992 | A45C/11/18 |
| FR | 2 462 359 | | 2/1981 | |
| GB | 239808 | | 9/1925 | |
| WO | WO 93/08714 | | 5/1993 | |

* cited by examiner

*Primary Examiner*—Mickey Yu
*Assistant Examiner*—Jila M. Mohandesi
(74) *Attorney, Agent, or Firm*—Jacobson Holman PLLC

(57) ABSTRACT

A case for containing cards, in particular visiting cards, credit cards, playing or postal cards, generally parallelepiped in shape, including two opposite surfaces and four side elements, in opposite pairs, two lateral and two transverse, and a device for inserting the cards in the case and dispensing them as requested. The card inserting and dispensing device is provided by one of the two surfaces which includes lateral slots located on the side edges opposite the lateral elements and a transverse slot located on one of its opposite transverse edges such that the surface is spaced apart from the case, by bending, each time the cards pass through.

9 Claims, 3 Drawing Sheets

CASE FOR DIFFERENT CARDS

This is a continuation of PCT/FR00/00906, filed Apr. 10, 2000 and published in French.

FIELD OF THE INVENTION

The invention relates to a case designed to contain cards, namely visiting, business, credit, playing or post cards, generally parallelepipedal, of the kind comprising two opposite faces and four side elements, opposite to each other, two by two, two lateral elements and two cross elements, as well as a device adapted for allowing that the cards are entered in the case and distributed at request.

BACKGROUND OF THE INVENTION

Known cases of this kind generally comprise removable covers as well as spring mechanisms facilitating the cards are hold and exit through a slot provided in the box or cover.

They have a complex and expensive conception and require the use of different tools, which ought to be amortized on large series.

In addition, this complexity also limits the selection of potential materials for their embodiment.

Other cases are disclosed in following documents:

GB-239808 which discloses a pliers comprising two faces made of resilient material and obtained by folding so that tickets or the like are received and held.

FR-2462359 which discloses a box comprising a slot for the entrance and exit of tickets and requiring for operating, on one hand, an inclined ramp for guiding the tickets downwards the exit slot and, on the other hand, a swivelling shutter, opposite to the said slot, for introducing tickets with in addition a top opening for pushing them.

The first does not correspond to a closed case designed to containing and protecting cards.

The second has a complex operation and embodiment.

SUMMARY OF THE INVENTION

It is in order to overcome these different drawbacks that the applicant devised a case having a simple conception, easy to be made and requiring no associated mechanism.

It is essentially characterized in that the device allowing to introduce and distribute the cards is embodied by means of two faces comprising side slots located on the side edges in front of opposite side edge elements and a cross slot located in one of its cross edges in front of one of the opposite cross side elements so that the face involved, which is only joined to the rest of the case by a cross edge, is taken apart from the said case, by bending, each time the cards are passing.

It can be made on a single piece by cutting and folding a sheet of cardboard, plastic, metal or other material.

It can also be made of injected plastic material.

The characteristics and advantages of the invention will be more apparent from the detailed description below of at least one preferred embodiment thereof for non-limitative example purpose and illustrated in the drawings attached.

DETAILED DESCRIPTION OF A PREFERRED EMBODIMENT

Figure 1:
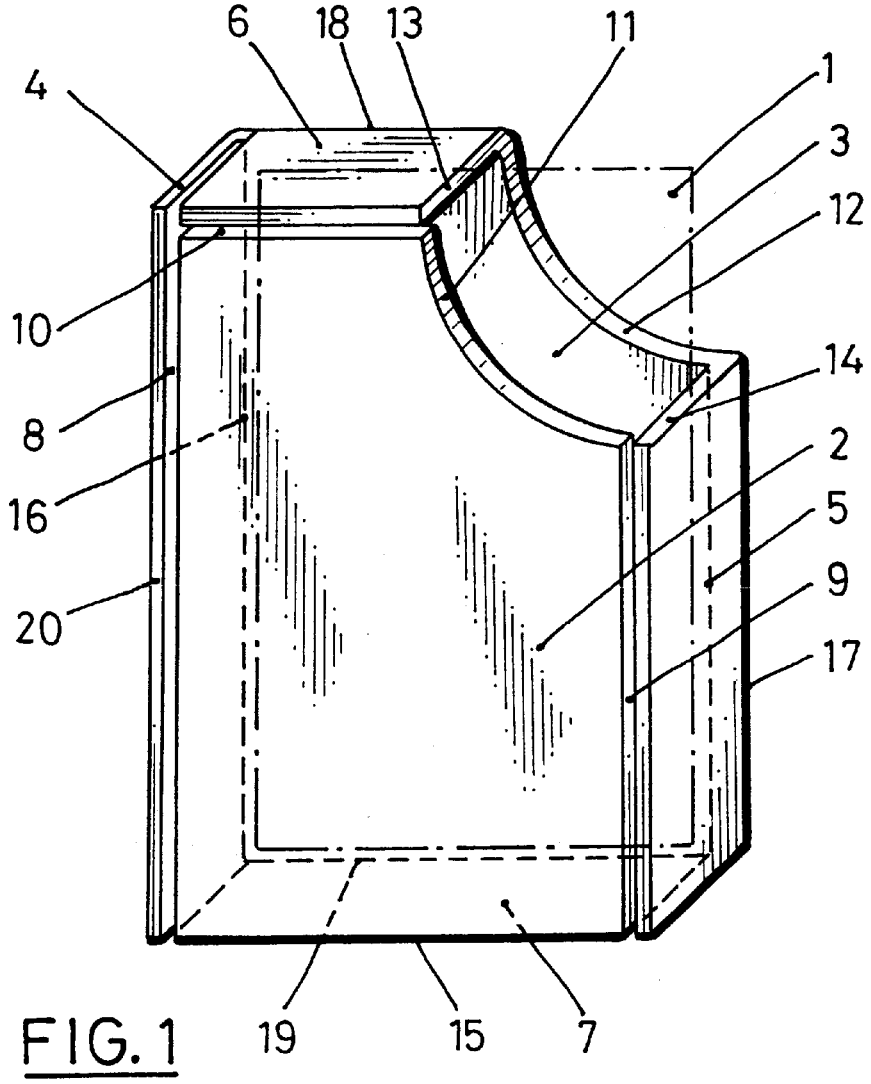
FIG. 1 is a view in perspective of the case according to the invention.
Figure 2:
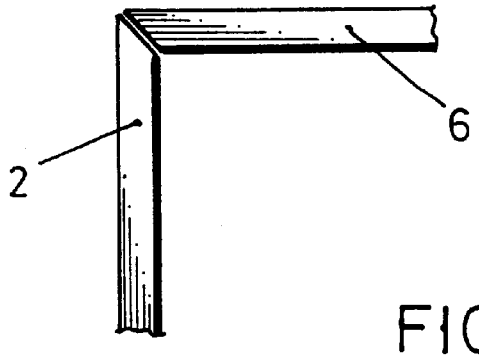
FIG. 2 is a detailed view of the junction between the flexible face and the side elements in front.
Figure 3:
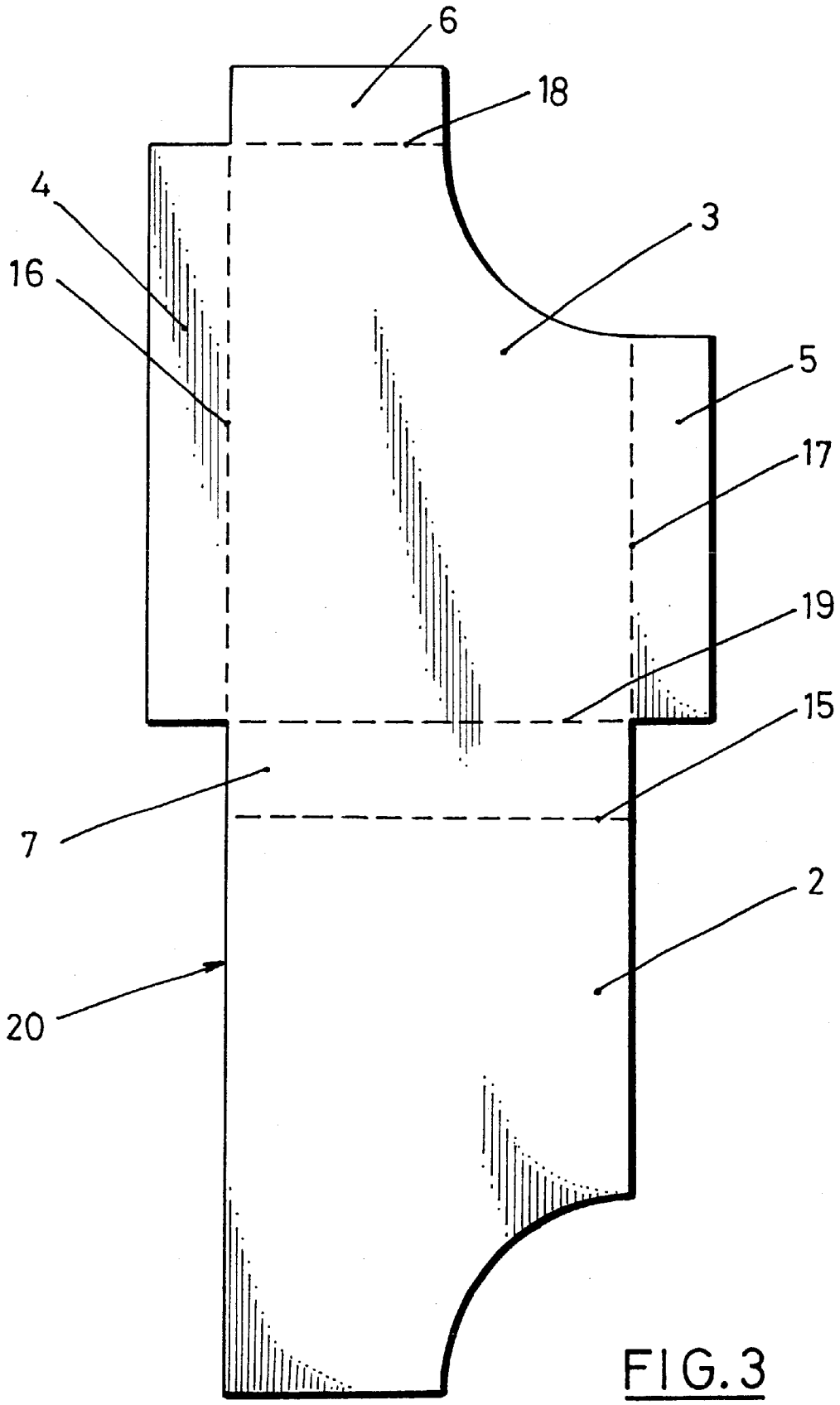
FIG. 3 is a flat view of the cutting and folding lines in an embodiment using the cuffing and folding technique.

The case illustrated in the figures is designed to contain cards (1), namely visit, business, credit, playing or post cards.

It is generally parallelepipedal of the kind comprising two opposite faces (2) and (3) and four side elements, facing each other, two by two, two side elements (4) and (5) and two cross elements (6) and (7), as well as a device adapted for allowing the introduction of the cards within the case and their distribution at request.

The device allowing that cards (1) are introduced and distributed is made by means of one of the two faces (2,3), for example face (2) which comprises side slots (8) and (9) located on its side edges in front of the side elements having opposite lateral sides (4) and (5) and a cross slot (10) located in one of its cross edges in front of one of the side elements having opposite cross sides (6,7) so that face (2) involved, which is only joined to the rest of the case by its cross edge (15) is taken apart from the said case, by bending, each time cards (1) are passing.

Faces (2) and (3) and side elements (5) and (6) respectively comprise cuttings (11), (12), (13) and (14) adapted for allowing to hold with the fingers cards (1) to be introduced or to be distributed.

The case can be made of a single piece by culling and folding a plate (20) along the folding lines (16) and (17) for the elements of the lateral sides (4) and (5), (18) and (19) for the cross side elements (6) and (7) and (15) for face (2).

It can also be made of injected plastic material, either of a single piece with further folding the side element (6) for example, or in two pieces to be fit together.

Figure 4:
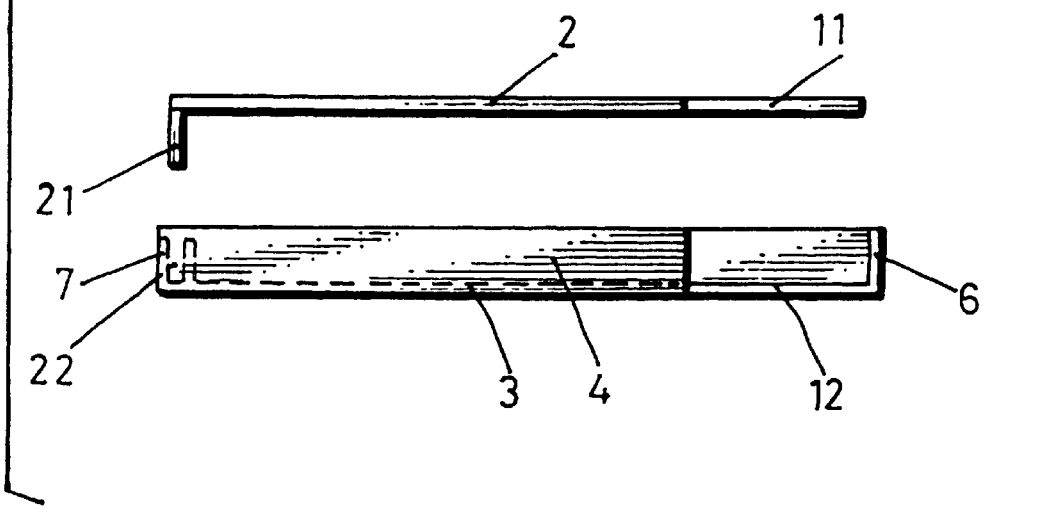
FIG. 4 is a side view showing another embodiment of the case according to the present invention using two pieces of injected plastic material to be fit together.

FIG. 4 shows two separate pieces able to be made of injected plastic material. A first one of said pieces comprises face 2 with cutting 11, while the other piece comprises face 3, side elements 4, 5, and cross elements 6, 7, with face 3, side element 5 and cross element 6 comprising cutting 12. Said two pieces include respective conventional snap fit means 21, 22 integral therewith, that allows the two pieces to be fit together to form the card case according to the invention.

The junction between the cross edge of face (2) and the cross edge of side element (6) can be chamfered to facilitate introducing and distributing the cards.

Also, the junctions between on one hand the cross edge and the lateral edges of face (2) and on the other hand, the cross edge of side element (6) and the side edges of side elements (4) and (5) can be chamfered for same reason.

The case can be made of material selected, namely, from paper, cardboard, plastic or metal.

Of course the invention is not limited to the embodiments disclosed for which other variations can be provided and namely in:

shape, proportions and sizes of the different elements constituting the case;

length of the side slots depending on the flexibility of the material used;

shape of the cuttings for holding the cards with the fingers;

materials used;

techniques of production, which can be provided.

What is claimed is:

1. A case designed to contain cards, said case comprising a generally parallelepipedal shape including two large opposite faces and four side elements, opposite to each other, two by two constituting two lateral side elements and two cross side elements, and a device to introduce and distribute cards embodied by one of said two faces including side slots located on side edges in front of the two opposite lateral side elements and a cross slot located in one edge of said one face in front of one of the two opposite cross side elements so that the one face, which is only joined to a rest of the case by an edge, is taken apart from the case, by bending, each time the cards pass through said cross slots.

2. The case, according to claim 1, wherein the two faces and one of the two lateral side elements and one of the cross side elements comprise cuttings adapted for allowing the cards to be introduced or to be distributed.

3. The case, according to claim 1, wherein the case is made of a single piece by cutting and folding a plate along folding lines for the lateral side elements, and for the cross side elements and for the one face.

4. The case, according to claim 1, wherein the case is made of injected plastic material, of a single piece.

5. The case, according to claim 1, wherein the case is injected plastic material in two pieces to be fit together.

6. The case, according to claim 3, wherein a junction between an edge of the one face and an edge of one of the two cross side elements is chamfered.

7. The case, according to claim 3, wherein junctions between the edges of the one face and between an edge of one of the two cross side elements and side edges of the two lateral side elements are chamfered.

8. The case, according to claim 4, wherein a length of the side slots varies depending on flexibility of material used.

9. The case, according to claim 1, wherein the case is made of material selected from a group including paper, cardboard, plastic and metal.

* * * * *